United States Patent [19]

Gwozdz

[11] 4,211,990

[45] Jul. 8, 1980

[54] ELECTRIC SWITCH CONCEALING HINGE

[75] Inventor: Joseph W. Gwozdz, Clark Summit, Pa.

[73] Assignee: McKinney Manufacturing Company, Scranton, Pa.

[21] Appl. No.: 923,022

[22] Filed: Jul. 10, 1978

[51] Int. Cl.[2] ..... H01H 36/00

[52] U.S. Cl. ..... 335/205; 200/61.7; 335/207

[58] Field of Search ..... 335/205, 207; 200/61.7

[56] References Cited

U.S. PATENT DOCUMENTS

| | | | |
|---|---|---|---|
| 3,896,404 | 7/1975 | Peterson | 200/61.7 |
| 4,072,917 | 2/1978 | Haag et al. | 335/205 |
| 4,075,588 | 2/1978 | Verger et al. | 335/207 |

*Primary Examiner*—Harold Broome

*Attorney, Agent, or Firm*—Brown, Flick & Peckham

[57] ABSTRACT

A hinge is secured to the jamb of a door frame and to a door in the frame. Behind the jamb leaf of the hinge the jamb is provided with a hole that is concealed by the hinge. The back of the jamb leaf is provided with a recess facing the hole. An electric switch and its operating magnet are mounted in a housing that is held in the jamb hole and projects into the jamb leaf recess. The housing is not attached to the hinge. In case the hinge leaves are substantially parallel when the door is closed, a ferrous area of the door leaf will activate the switch. If the hinge leaves are at right angles to each other when the door is closed, a ferrous metal area of the edge of the door itself activates the switch.

5 Claims, 7 Drawing Figures

ELECTRIC SWITCH CONCEALING HINGE

Door hinges installed in buildings are sometimes provided with electric switches that control electric circuits operating lights or audible signals so that an observer or monitor remote from the doors can tell whether or not the doors are closed or whether they have been opened by unauthorized persons. In many cases the presence of the switches is revealed whenever the doors are open, making it possible for a would-be intruder to deactivate the monitoring system in some way before attempting an entrance. Furthermore, some swithces that are rigidly mounted on hinges project a considerable distance into holes in the jambs to which the hinges are secured, as shown in U.S. Pat. No. 3,806,852. When the switches are magnetically operated, the operating magnets likewise project from the hinges into holes in the doors. In such cases, when a workman unscrews a hinge from a door frame, if he does not realize that a switch extends into the jamb he may try to swing the hinge leaf away from the jamb. This often results in breaking off the switch, which should be removed from the jamb only by pulling it straight out of the hole in which it is disposed.

It is an object of this invention to provide magnetically activated switches and their operating magnets which are completely concealed by door hinges but which are not attached to the hinges. Another object is to provide a hinge formed to allow a switch magnet to be located closer to its actuating member than the thickness of a hinge leaf when the door is closed, and in which only one leaf of the hinge needs to be modified.

The invention is illustrated in the accompanying drawings, in which

Figure 1:
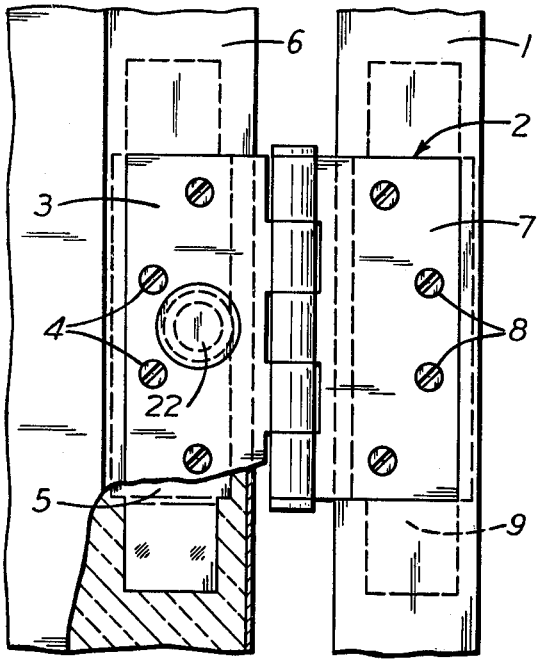
FIG. 1 is a view of the exposed or front side of an open hinge attached to a metal door and jamb.
Figure 2:
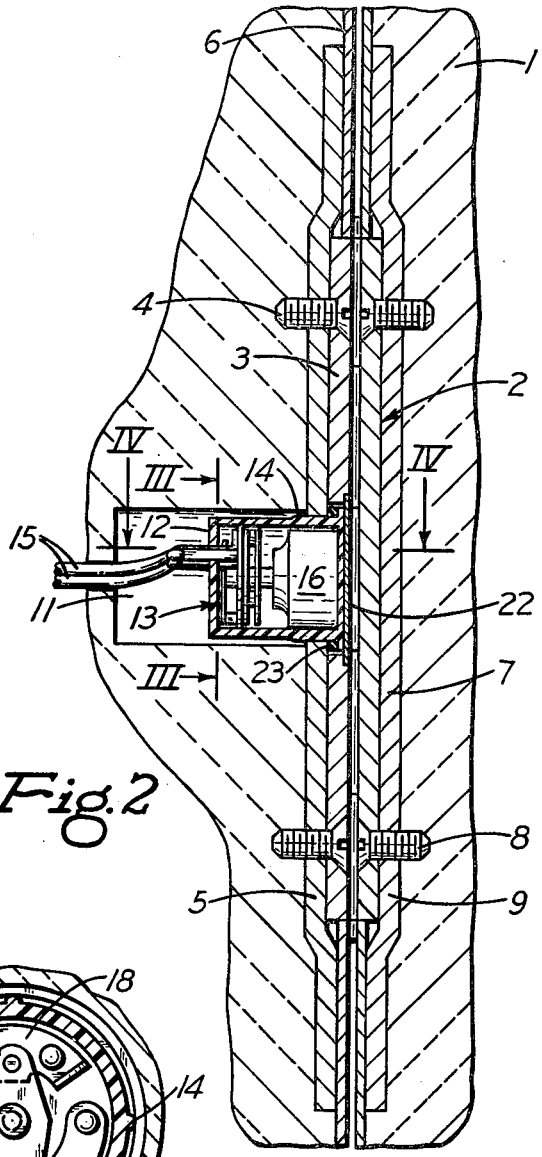
FIG. 2 is an enlarged vertical section of the closed hinge, with the switch housing also shown in section.

Referring to FIGS. 1 and 2 of the drawings, a metal door 1 is shown provided with a hinge 2, usually the middle one of three vertically spaced hinges. This hinge has a jamb leaf 3 connected by screws 4 to a narrow metal plate 5 welded to the inner surface of the sheet metal 6 forming the jamb of a door frame, and a door leaf 7 connected by screws 8 to a similar plate 9 welded to the sheet metal forming the adjacent edge of the door. The hinge leaves are set into openings in the sheet metal, with their outer faces flush with the outer surfaces of the jamb and door.

Figure 3:
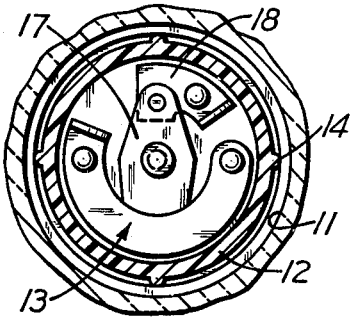
FIG. 3 is an enlarged cross section of the switch housing, taken on the line III—III of FIG. 2.
Figure 4:
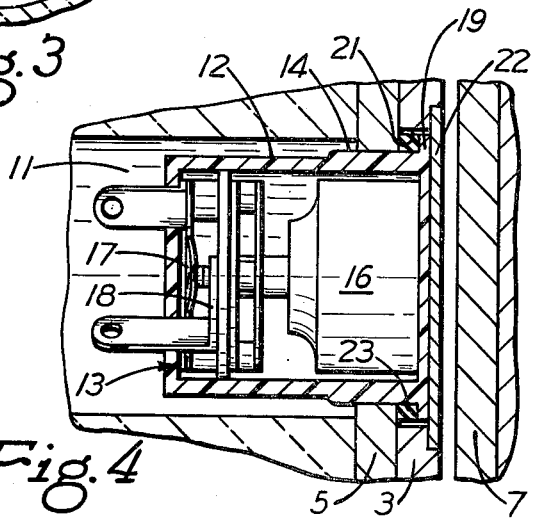
FIG. 4 is an enlarged longitudinal section of the switch housing, taken on the line IV—IV of FIG. 2.

Behind the central part of jamb leaf 3 the jamb is provided with a hole 11, as shown in FIG. 2, in which the housing 12 for a magnetically operated electric switch 13 is rigidly mounted. The housing may be plastic or non-ferrous metal provided with circumferentially spaced longitudinal ribs 14 that press against the wall of an opening through plate 5. The usual wires 15 connected to the switch terminals extend out of hole 11 and are connected with a signal light or other monitoring element (not shown). If a signal light is used, the switch can be normally open or normally closed, but if an audible alarm is used, the switch should be normally closed. In either case, the switch is operated by a magnet 16 that is slidably mounted in the outer end portion of the housing. The magnet is connected to the movable switch spring contact 17 shown in FIGS. 3 and 4 in order to pull it into engagement with the fixed contact 18 when a normally open switch is used. A flange 19 encircling the outer end of housing 12 limits the distance that the housing can be inserted in the hole in the jamb. The thickness of this flange is less than the thickness of the adjoining door leaf.

The back of the jamb leaf of the hinge is provided with a recess 21 facing the jamb and axially aligned with the hole 11 in the jamb. This recess extends most, but not all, of the way through the hinge leaf. If the hinge is brass or some other non-ferrous metal, the recess is produced by simply boring a hole of the desired depth in the jamb leaf. On the other hand, if the hinge is made of steel, as shown, the recess is formed by drilling a hole entirely through the jamb leaf and then closing its outer or front end with a disk 22 of non-ferrous metal. The disk is attached to the hinge in any suitable manner, such as by counterboring the outer end of the hole and then setting the disk into the leaf and braxing it in place to form the front wall of the recess. The outer face of the disk should be flush with the surrounding surface of the hinge leaf. After polishing and plating, the disk is not visible. The flange 19 at the outer end of the switch housing extends into recess 21 as far as its front end wall 22. If the flange happens to be thinner than the depth of the hinge recess that receives it, as shown, the flange can be held against disk 22 by a spacer, such as an O-ring 23, encircling the switch housing behind the flange.

The result of this construction is that the outer end of the switch housing and the magnet are separated from the door leaf 7 of the hinge a distance that is considerably less than what it would be if the jamb leaf were not provided with recess 21. Consequently, the influence of the door leaf on the magnet is improved. When the door is closed, the door leaf attracts the magnet as shown, which closes the switch. Upon opening the door, the spring contact 17 retracts the magnet and the switch is open.

The switch housing is independent of and free of the hinge. It is installed before the hinge, and the hinge can be removed without disturbing it, thereby avoiding the possibility of damaging it. If the switch housing has to be removed for any reason, it will be clear to the workman that it must be pulled straight out of the mounting plate 5. While the hinge is in place, the switch and magnet are completely concealed from view. A further advantage is that the door leaf of the hinge does not need to be modified in any way if the hinge is steel.

Figure 5:
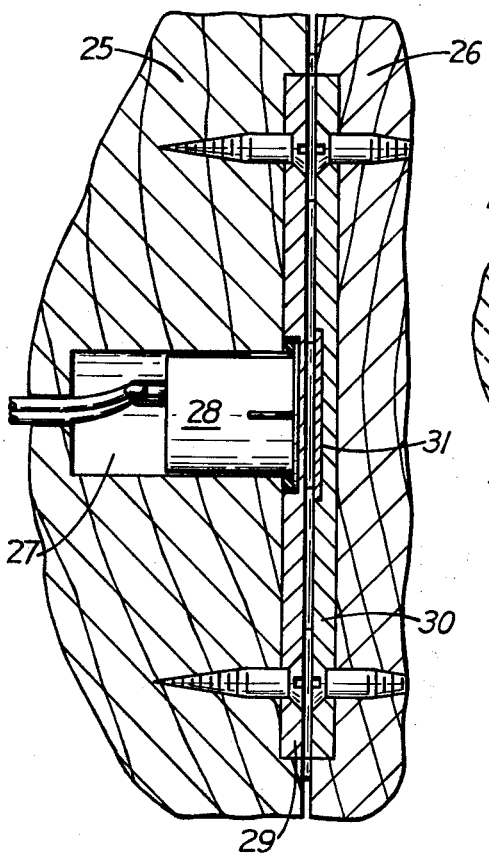
FIG. 5 is a vertical section, similar to FIG. 2, of a hinge attached to a wooden door and jamb.

In case the hinge is to be used with a wooden door frame 25 and wooden door 26 as shown in FIG. 5, the door frame or jamb is provided with a hole 27 for receiving the switch housing 28 that contains both switch and magnet like the one first described. The outer end of the housing projects into a recess in the adjoining jamb leaf 29 of a hinge. The hinge may be made the same as the one in the first embodiment, or, as shown, it may be a non-ferrous hinge, such as brass. In such a case, the door leaf 30 is provided with a recess facing the jamb leaf and alighed with its recess. A steel disk 31 is rigidly mounted in the door leaf recess for attracting the magnet when the door is closed, whereby to actuate the switch.

Figure 6:
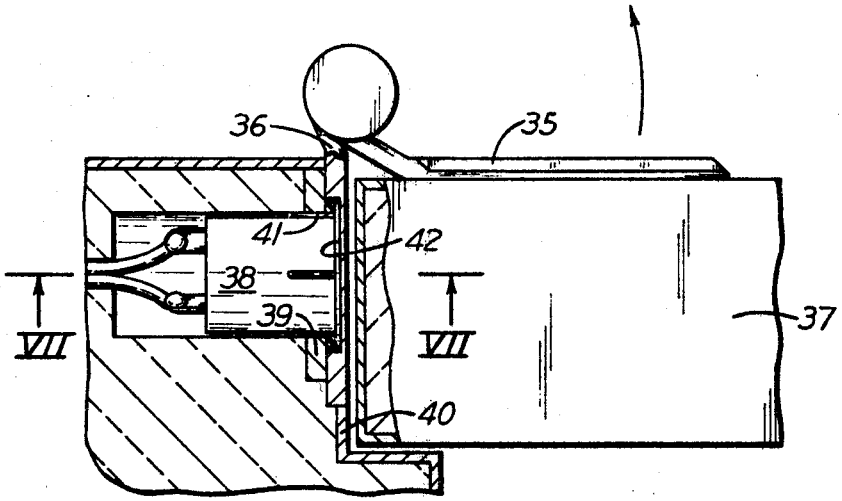
FIG. 6 is a horizontal section through a modification.
Figure 7:
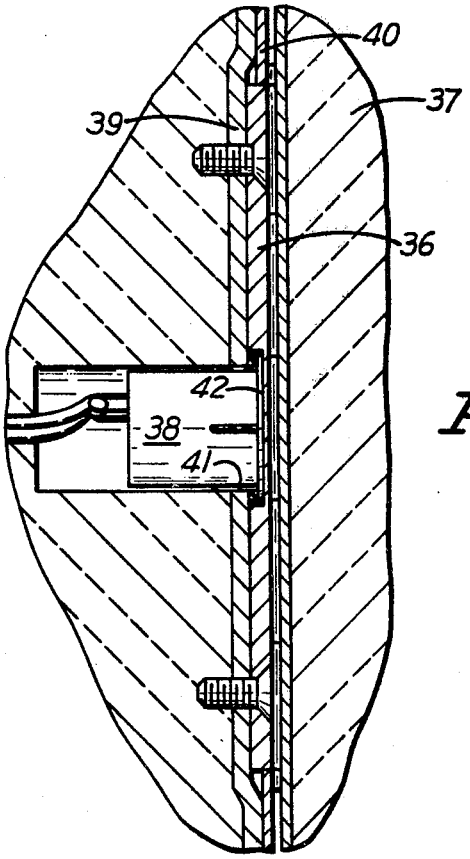
FIG. 7 is a vertical section taken on the line VII—VII of FIG. 6.

The type of hinge shown in FIGS. 6 and 7 is known as a half surface hinge. Instead of the door leaf 35 being disposed between the jamb leaf 36 and the door 37 when the door is closed, the door leaf is perpendicular to the jamb leaf because it is fastened to one side of the door, not its edge. This means that the door itself must activate the magnetic switch 38 that is mounted in a narrow metal plate 39 secured in the metal jamb 40. The switch extends into a hole 41 in the jamb and also projects into a recess 42 in the jamb leaf that is fastened to mounting plate 39.

If a steel door is used, as shown, the edge of the door itself will attract the switch magnet when the door is closed. If the door is wood, the edge of the door opposite the switch is provided with a ferrous metal plate to attract the magnet when the door is closed.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In combination with a door frame having a jamb and containing a normally closed door member, a hinge with a jamb leaf and a door leaf member, means securing the jamb leaf to said jamb, means securing the door leaf member to said door member, one of said members having a surface facing said jamb leaf in close proximity thereto when said door member is closed, the jamb having a hole extending into it from behind the jamb leaf of the hinge and concealed by said leaf, the back of said jamb leaf being provided with a recess facing the jamb hole and having a non-ferrous front wall, at least the area of said one member surface opposite said front wall being ferrous metal, and an electric switch housing secured in said jamb hole and projecting into said jamb leaf recess, the housing containing an electric switch and a permanent magnet for activating it when the door member is closed and attracts the magnet, said switch housing being concealed by and unattached to said hinge so that the hinge can be removed from said jamb without disturbing the housing.

2. In the combination recited in claim 1, said hinge leaves being steel, and said recess being formed by an opening extending through said jamb leaf and by a non-ferrous disk forming said recess front wall, said disk being secured in said opening substantially flush with the surrounding surface of the hinge leaf.

3. In the combination recited in claim 1, said hinge leaves being non-ferrous, said surface of said one member being provided with a recess opposite said switch housing, and a ferrous metal disk rigidly mounted in said last-mentioned recess for attracting said magnet.

4. In the combination recited in claim 1, said door leaf member of the hinge being secured to one side of the door member and disposed at substantially a right angle to the jamb leaf when the door member is closed.

5. In the combination recited in claim 4, said door member being steel.

* * * * *